United States Patent [19]

Colbert

[11] Patent Number: 4,958,834

[45] Date of Patent: Sep. 25, 1990

[54] GOLF CLUB ASSEMBLY

[76] Inventor: Robert E. Colbert, 2905 S. Wooddale, Jackson, Mich. 49203

[21] Appl. No.: 438,972

[22] Filed: Nov. 20, 1989

Related U.S. Application Data

[63] Continuation of Ser. No. 194,168, May 16, 1988.

[51] Int. Cl.[5] ..... A63B 53/00; B23P 11/00

[52] U.S. Cl. ..... 273/77 A; 273/80 B; 273/80.2; 273/80.9; 29/428

[58] Field of Search ..... 273/80 R-80.9, 273/77 A, 194 R, 194 A, 81 B, 81.3, 183 D, 186 R, 162 R, 167 R, 77 R; 73/847, 849, 66; 29/464, 525, 526 R, 428, 400, 425; 156/293, 294

[56] References Cited

U.S. PATENT DOCUMENTS

| | | | |
|---|---|---|---|
| 1,626,476 | 4/1927 | Nicholls | 273/80.9 |
| 1,626,477 | 4/1927 | Nicholls | 273/80.9 |
| 1,942,445 | 1/1934 | Oldham | 273/80.9 X |
| 2,074,986 | 3/1937 | Lagerblade | 273/80 B X |
| 2,116,762 | 5/1938 | Kraeuter | 273/80.5 |
| 2,177,970 | 10/1939 | Wettlaufer | 273/80.9 |
| 3,176,987 | 4/1965 | Johnston | 273/77 R |
| 3,685,135 | 8/1972 | Letters | 273/80 B |
| 4,169,595 | 10/1979 | Kaugars | 273/77 A |
| 4,203,598 | 5/1980 | Stuff et al. | 273/77 A |
| 4,253,666 | 3/1981 | Murphy | 273/77 A |
| 4,558,863 | 12/1985 | Haas et al. | 273/77 A |

FOREIGN PATENT DOCUMENTS

| | | | |
|---|---|---|---|
| 5093335 | 2/1977 | Japan | 273/80 B |
| 3288 | of 1913 | United Kingdom | 273/80 B |
| 483995 | 4/1938 | United Kingdom | 273/80 B |
| 518699 | 3/1940 | United Kingdom | 273/80 B |
| 1313751 | 4/1973 | United Kingdom | 273/80 B |

*Primary Examiner*—Paul E. Shapiro
*Assistant Examiner*—Sebastiano Passaniti
*Attorney, Agent, or Firm*—Beaman & Beaman

[57] ABSTRACT

The invention pertains to the assembly of golf clubs, and in particular, pertains to the assembly of golf clubs utilizing a longitudinally extending seam. To minimize adverse effects of bending and torsion forces on a seamed shaft when striking the ball, the shaft seam is oriented to the club face in a predetermined orientation, and all of the shaft seams in a set of golf clubs may be oriented to provide consistent performance of the clubs of a common set.

10 Claims, 1 Drawing Sheet

GOLF CLUB ASSEMBLY

BACKGROUND OF THE INVENTION.

Golf clubs consist of an elongated shaft having an upper end upon which a hand grip is defined, and a club head is attached to the shaft lower end having a ball-striking face defined thereon. The ball-striking face is usually off center with respect to the longitudinal axis of the shaft, and upon striking a ball the radial distance between the point of ball impact with the head face with respect to the shaft axis will produce a torsional twisting force on the shaft as well as produce lateral shaft bending forces.

To improve the consistency and performance of golf clubs considerable effort has been expended toward the art of balancing the club and controlling the shaft bending characteristics. Typical examples of developments of this type are shown in U.S. Pat. Nos. 4,203,598 and 4,558,863. The configuration and technology of a golf club seam has also been the object of considerable research and typical disclosures of this type are shown in U.S. Pat. Nos. 1,942,445; 2,074,986 and 2,177,970.

To improve the performance of putters, concern has been expressed with respect to the alignment of the club head hosel axis and the club shaft, and U.S. Pat. No. 3,176,987 discloses apparatus for improving club assembly in this respect.

Prior to golf club shafts being made of metal and synthetic materials, club shafts were formed of wood sections cemented together, and in the wood club shaft art it was known to vary the physical characteristics of the shaft by using different types of wood at various circumferential locations of the shaft, and disclosures of this type are shown in U.S. Pat. Nos. 1,626,476 and 1,626,477.

To date, by far the greatest percentage of golf club shafts are formed of metal, while materials such as fiberglass, graphite and the like are also employed. Such shafts have a much greater strength than wood shafts, and are able to produce a stronger and more consistently functional operation than wood shafts. In the manufacture of such non-wood shafts a single longitudinally extending seam is employed to maintain the cylindrical configuration of the shaft and the art of forming golf club shafts is highly developed as illustrated in U.S. Pat. Nos. 1,942,445; 2,074,986 and 2,177,970. The art of manufacturing golf club shafts has progressed to the point that the shaft seam is invisible both exteriorly and interiorly of the hollow shaft, and the presence of the seam does not visually distract from the shaft appearance.

Most golf club seams, particularly with metal shafts, are of a butt weld wherein the shaft is formed by rolling the shaft blank into a tapered substantially cylindrical configuration so that the ends of the blank are in opposed relationship and are butt-welded together to maintain the shaft configuration. While this welding operation may be so accurately accomplished as to prevent the seam from being visible, the presence of the seam does affect the torsional and bending characteristics of the shaft. For instance, the location of the seam adds a "stiffness" to the lateral bending shaft characteristics, and also affects the shaft torsional characteristics with respect to the shaft axis. Thus, the shaft seam affects the physical characteristics of the shaft and deflection and recovery of the shaft upon a golf ball being struck. Such shaft characteristics will, to a considerable extent, affect the flight trajectory of the ball.

Presently, to the inventor's knowledge, no golf club manufacturer is assembling golf club shafts and heads wherein the shaft seam is oriented in a predetermined manner to the club head or head ball-striking face. Most golf club shafts and club heads are assembled by inserting the lower end of the shaft within a cylindrical recess defined in the head hosel and epoxy is used to maintain the shaft within the club head hosel recess. The shaft and head are assembled without regard to the rotational position of the shaft with respect to the head, and without regard to the location of the shaft seam adjacent the head with respect to the head ball-striking face. Thus, present golf club manufacturers are oblivious to the relationship of the seam to the golf club face, and even if it was desired to relate the shaft seam to the head face, such an orientation is very difficult to achieve as the position of the shaft seam with respect to the shaft cannot readily be determined.

Accordingly, because of the haphazard assembly of the shaft and head with respect to the location of the shaft seam, many golf clubs have a "built-in" reaction to the forces imposed upon the club during impact with a ball which may tend to "hook" or "slice" the ball. Only if the seam happens to be located at a "neutral" location can such inherent characteristics be eliminated from the club. Also, it is most likely that, even in a set of "matched" clubs, the seam of each club shaft will be oriented to the associated club head face in a different angular relationship imparting to each club of a set different characteristics with respect to bending and torsion which works against the golfer's desire to produce uniform results with different clubs. Avid or professional golfers often find "favorite" clubs which feel right to them and often use mismatched clubs with which consistent results are achieved. Although it has not been previously appreciated, such consistency between various different clubs in a mismatched set is very likely to be due to the fact that the club shaft seams are oriented to the club head in a manner which substantially eliminates adverse influences of the shaft seam on the club operation.

It is an object of the invention to provide a method of assembling a seamed golf club shaft and head wherein predetermined torsional and bending characteristics of the club during use can be achieved.

Another object of the invention is to provide a golf club having a seamed shaft wherein the seam is so related to the club head that the adverse effect of the shaft seam to the characteristics of club shaft bending and torsion forces are eliminated or neutralized.

Yet another object of the invention is to provide a golf club having a seamed shaft wherein the shaft seam is so oriented to the club head face that the seam is in a "neutral" location with respect to the head ball-striking face as to eliminate reaction forces within the club shaft which adversely affect the flight of a struck ball.

Yet another object of the invention is to provide a golf club having a seamed shaft wherein the location of the shaft seam to the club-striking face is oriented in a predetermined manner to compensate for deviations within the particular user's golf swing.

Yet an additional object of the invention is to provide a set of a plurality of golf clubs having seamed shafts attached to heads wherein the relationship of the seams of each club shaft are pre-oriented to render the clubs of the set with consistent physical bending and torsional characteristics to provide a consistency of club operation for the entire set.

To practice the invention it is first necessary to locate the position of the seam of a seamed golf shaft. Golf club shafts are usually of a tapered configuration, the larger diameter end having a hand grip mounted thereon, and the smaller diameter end being attached to the club head. The shaft seam which occurs during the manufacture of most club shafts extends longitudinally the length of the shaft, and throughout its length is substantially consistently related to the circumferential configuration of the shaft, i.e. the rotational location of the seam relative to the shaft axis remains substantially constant with respect to the shaft length.

Locating the shaft seam on the circumference of the hollow shaft is often difficult due to the expertise used in forming the seam, which is usually of a butt-weld type. An acceptable manner for locating the seam is to place the shaft under a bending stress while the shaft is rotated about its axis and the flexing characteristics of the shaft during such bending and rotation can be readily discerned as the bending characteristics fluctuate in accordance with the location of the seam. In this manner the location of the seam on the shaft may be accurately determined.

After the shaft seam is located, its location is marked, and when assembling the club head to the lower end of the shaft, the seam is oriented to the head ball-engaging face in a predetermined manner. Usually, the head hosel includes a socket having a diameter slightly greater than that of the shaft lower end as to closely receive the shaft lower end and assembling of the shaft and head is produced by using an epoxy adhesive to affix the shaft within the hosel socket.

When locating the shaft seam to the club ball-striking face it is usually desired that the seam be located at a "neutral" location with respect to the club face and the forces imposed upon the club upon the head engaging a ball. By reference to a "neutral" location it is meant that the seam is so oriented to the club face that the influence of the club seam upon the bending end torsional characteristics of the shaft do not adversely affect the flight of the struck ball. Experience has shown that the preferred location of the shaft seam is at the "rear" of the club with respect to the direction of club movement during the normal club swing when striking a ball. Thus, in most instances, the shaft seam will be located 180° opposite to the direction of movement of the club head during the club swing. However, it is also possible to locate the seam at the "front" of the club, i.e. in the direction of swing movement, and it is conceivable that location of the seam at either of the 90° locations with respect to the rear or front of the club would produce a "neutral" reaction which would not significantly adversely affect the ball movement.

By locating all of the seams of the shafts of a set of golf clubs, either woods or irons, or both, the bending and torsional characteristics of each club will be the same and a user will be assured of uniform club response and reaction regardless of which club is being used.

Because of the "stiffness" of the club shaft adjacent the welded seam it is possible to use the adverse effect of obliquely relating the position of the club seam with respect to the club face to overcome deviations in the golf swing of a particular golfer. Many golfers have an incorrect golf swing which will cause the ball to hook to the left or slice to the right due to an improper movement of the club head with respect to the ball. By locating the shaft seam to the club head it is possible to produce a golf club which has a slight inherent hook or slice built into the club, and by orienting the seam to the club head in such a manner to compensate for the deviations of the golf swing of a particular golfer, the club can be "customized" for a particular golfer to minimize the effect of an improper swing. Likewise, if a golfer's swing should slightly vary with respect to the use of woods or irons, or even particular clubs within the wood or iron set, each club can be "customized" for a particular golfer with respect to the location of the shaft seam to the club head.

BRIEF DESCRIPTION OF THE DRAWINGS.

The aforementioned advantages and objects of the invention will be appreciated from the following description and accompanying drawings wherein.

Figure 1:
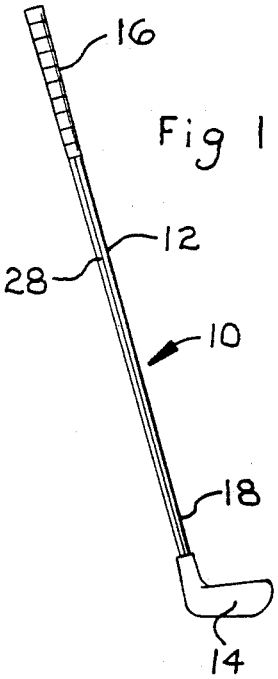
FIG. 1 is an elevational view of the rear of a golf club utilizing the invention.
Figure 2:
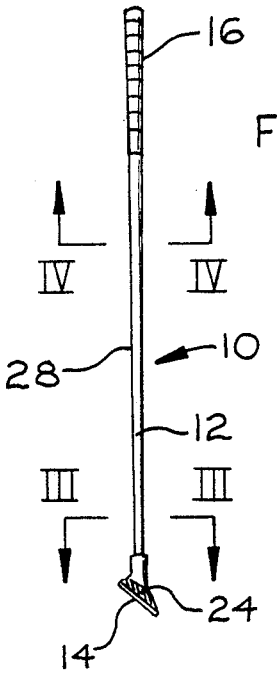
FIG. 2 is an elevational view of a golf club in accord with the invention as taken from the right of FIG. 1.
Figure 3:
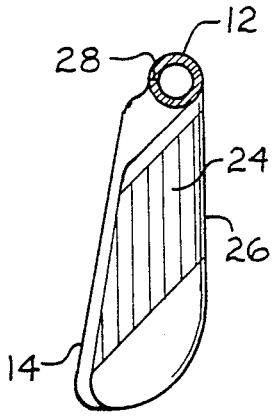
FIG. 3 is a plan sectional view as taken through the golf shaft of FIG. 2 along Section III—III.
Figure 4:
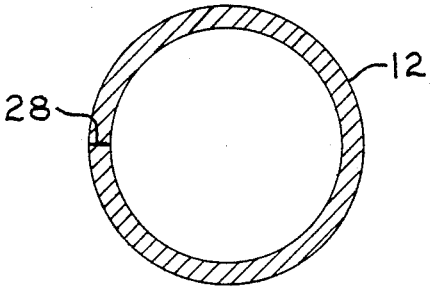
FIG. 4 is a sectional view as taken along Section IV—IV of FIG. 2.

DESCRIPTION OF THE PREFERRED EMBODIMENT.

The concepts of the invention are utilized with conventional golf clubs as illustrated at 10. Such a golf club basically consists of an elongated tapered shaft 12 having a club head 14 attached to the lower end of the shaft. At its upper end, the golf club will include the hand grip 16, and the shaft lower end affixed to the club head is indicated at 18.

The invention may be employed with either woods or irons, and the golf club 10 represented is a number 6 iron of typical construction. The club head 14 includes an upwardly extending hosel 20 having a socket 22 defined therein for receiving the lower end 18 of the shaft 12. Epoxy may be used to adhere the shaft within the socket 22 and diametrically extending pins may also be employed. The club includes a ball-striking face 24 which often includes horizontally extending lines and is usually roughened to increase the frictional contact with the golf ball. The lower end of the face 24 is defined by an edge 26 which is of a generally linear configuration, but usually has a slight convex form. Of course, the angle of the face 24 to the axis of the shaft 12 varies according to the type of club.

The shaft 12 is usually formed of steel, and is often constructed in its tapered configuration in steps of sequentially reduced diameter from the hand grip 16 toward the lower end 18. Steel golf club shafts are formed by rolling a strip of steel into the circular configuration and the edges of the shaft blank are butt welded, usually electrically, creating a seam 28 and producing a continuous circumference. The seam 28 extends the entire length of the shaft and is substantially "parallel" to the shaft axis, i.e. the circumferential position of the seam with respect to the shaft axis remains substantially constant throughout the shaft length. After welding, various sizing and secondary operations may be performed on the shaft, and the method of forming the shaft constitutes no part of the invention. The invention may be practiced with golf club shafts manufactured by any conventional technique utilizing a longitudinally extending seam 28.

It is to be understood that while the majority of golf club shafts 12 are formed of metal, the concepts of the invention may also be practiced with club shafts formed of other materials, such as synthetic compositions. Graphite, glass fibre, boron, and other synthetic materials are used to form club shafts, and the methods of construction of shafts of such materials often result in a seam of one type or another resulting. The concepts of the invention may also be practiced with such club shafts having the equivalent of a "seam", for instance, shafts formed of "seamless" tubing which have a longitudinal spine area of different physical characteristics than the remainder of the shaft circumference and it is these types of variations which causes the bending and torsional characteristics of the shaft to vary with respect to the shaft circumference and in this application the word "seam" is used to designate this circumferential shaft region.

The presence of the shaft seam 28 affects the bending and torsional characteristics of the shaft. In the process of the welding or bonding operation, the club shaft metal adjacent the seam is heated or otherwise worked such that the shaft material adjacent the seam has a different molecular structure and other physical characteristics as compared with the remaining shaft circumference and the existence of the seam itself interrupts the integrity of the shaft circumference. Thus, the seam causes the shaft to be "stiffer" adjacent the seam 28 thereby affecting the lateral bending action of the shaft, and also affecting the torsional and resilient characteristics of the shaft as it recovers from bending and torsion. It is these unsymmetrical characteristics of the golf club shaft with which the practice of the invention overcomes and neutralizes.

In the practice of the invention the shaft seam 28 is oriented to the club head 14, and in particular, to the face 24 and edge 26 in a predetermined manner. Thus, the reaction of the golf club 10 when striking a ball, and when swinging, will be determinable and consistent resulting in a club that will have consistent ball projecting results. A set of golf clubs assembled in accord with the invention will be consistent from club to club and the golfer can expect the same results from each club as long as the club swing and engagement with the ball is correct.

Under previous golf club assembly techniques no concern of the location of the shaft seam 28 to the golf club face 24 has been expressed or appreciated. Part of this problem is due to the fact that with conventional club manufacturing techniques the location of the seam 28 is virtually impossible to determine. Seam manufacturing techniques have become so skilled that the seam 28 is not visible either exteriorly of the shaft, nor from the interior. Probably, because of the inability to visually observe the seam, golf club manufacturers have assumed that the location of the shaft seam with respect to the head is of no consequence, and possibly, some golf club assemblers are not even aware that the shaft has a seam.

Figure 7:
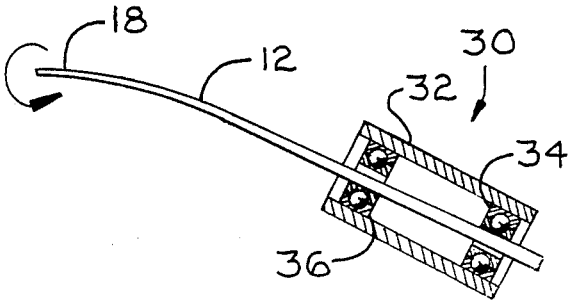
FIG. 7 is a sectional view illustrating apparatus for locating the shaft seam.

While it would probably be possible to determine the location of the seam of a metal shaft by acids to etch the interior of the club such partial destructive testing is not desirable, and the applicant employs a nondestructive system for locating the shaft seam as illustrated in FIG. 7.

The shaft seam locator 30 consists of a cylindrical tube 32 which is held stationary, such as in a vise or other supporting member. Within the tube 32 a pair of ball bearings 34 and 36 are located in axially spaced relationship. The spacing between the bearings 34 and 36 may be in the order of ten or twelve inches. The bore within the bearings' inner race is slightly larger than the diameter of the larger end of the shaft 12 before the hand grip 16 is affixed, and the shaft 12 is placed within the locator 30 shown in FIG. 7.

With the larger diameter end of the shaft 12 located within the bearings 34 and 36 the outer end 18 is manually deflected causing the shaft to bend an inch or so from its normal linear configuration. The shaft is then rotated with the fingers in either one direction or the other. As the club shaft is rotated a variation in the force required to maintain the shaft deflected will be readily apparent to the operator due to the difference in the bending characteristics of the shaft because of the presence of the seam 28. In this manner the circumferential location of the seam 28 may be readily determined without destructive testing of the shaft, and the user may make a physical mark on the exterior of the shaft to indicate the location of the seam 28.

After the seam 28 has been located the assembler will place epoxy on the lowermost portion of the shaft end 18, or within the socket 22, and insert the shaft 18 into the club head socket. In so doing the assembler will be aware of the location of the seam 28 and locate the shaft seam relative to the club head and face 24 as desired and predetermined.

Figure 5:
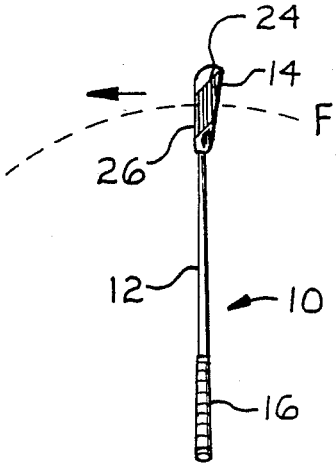
FIG. 5 is a plan view of a golf club utilizing the invention, the path of movement of the club head for a right-hand golfer being illustrated.
Figure 6:
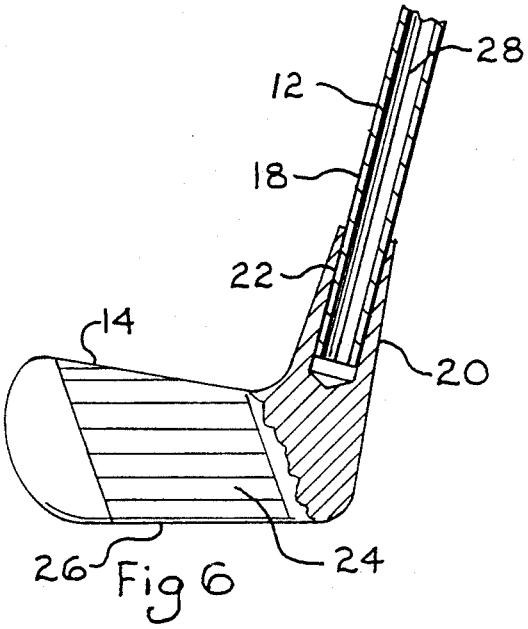
FIG. 6 is an enlarged, detail, partially sectioned elevational view of a club head as assembled to a shaft in accord with the invention.

With reference to FIG. 5 a plan view of a typical golf club is illustrated for a right-hand golfer and the arc of the club head during a correct golf swing is represented by dotted lines. The arrow represents the direction the club head will be moving when striking the ball, and the direction of the arrow of FIG. 5 will indicate the "front" of the club, i.e. the club face 24 will be located at the front of the club and the front of the shaft 12 will be that portion of the shaft facing the direction of movement of the club during the golf swing. The "rear" of the shaft 12 is located 180° with respect to the shaft front.

Experience has shown that, in most instances, the preferred location of the shaft seam 28 is at the rear of the shaft with respect to the direction of club movement during swinging. This location of the seam 28 places the seam at a relative "neutral" location with respect to the club face 24 and edge 26 eliminating club bending or twisting characteristics which would impart a deviation to the ball during flight in either a slice or hook direction. The seam 28 can also be located at the front of the shaft as this location will also be neutral with respect to the head face, but it has been found by locating the stiffest part of the shaft, i.e. the seam 28, at the rear of the shaft, maximum ball driving distance is achieved.

It is also to be appreciated that locating the seam 28 at 90° intermediate the front and rear of the shaft are also "neutral" locations with respect to the head face 24, but these locations are not as preferable as either the rear or the front.

The concepts of the invention may be utilized with either woods or irons, and it will be appreciated that by locating the shaft seam 28 in the same location with respect to the associated club head face that uniform bending characteristics of the various clubs of a set will be achieved and equipment variations between clubs eliminated.

Because the ball projecting characteristics of a golf club will vary because of the relationship between the shaft seam 28 and the head face 24 it is possible to purposely orient the seam 28 to the club face during assembly of the shaft and head to achieve an intentional deviation in the ball projecting path. Thus, if a golfer finds that his swing with certain clubs has a consistent deviation from a normal swing locating the seam 28 of that particular club in a predetermined manner to the associated club head face can impart to the club characteristics tending to "straighten out" that particular golfer's ball movement. Likewise, a golfer having a consistent hook or slice may desire his clubs to be assembled in such a manner that the shaft seam of each club will be consistently misaligned with respect to a "neutral" location between the shaft and head to help straighten out the ball movement of a golfer having a consistent hook or slice.

Avid golfers and professionals have tried and used many clubs, and often find clubs which they feel perform better and more consistently than others. Very likely, such clubs have become a "favorite" because the shaft seam was inadvertently oriented to the club face in that manner which produced the best results for that particular golfer. However, clubs are normally sold in sets wherein the golfer buys all of the woods or all of the irons at the same time, and due to the haphazard manner in which golf club shafts and heads are conventionally assembled uniform results between the various clubs of a set are not obtained. The practice of the invention overcomes this heretofore unappreciated aspect of golf club assembly.

It is appreciated that modifications to the inventive concepts may be apparent to those skilled in the art without departing from the spirit and scope of the invention.

I claim:

1. The method of assembling a golf club having an elongated shaft having a circumference, an axis, a longitudinally extending seam inherently resulting from the shaft manufacture and a lower end to a club head having a hosel for attaching the head to the shaft lower end and a ball-striking face including an elongated lower edge wherein the assembled golf club has a front side defined by the direction of club movement during the striking of a golf ball and a rear side 180° opposite to the front side comprising the steps of:

(a) locating the position of the shaft seam adjacent the shaft lower end relative to the shaft circumference, (b) orienting the shaft to the club head face in a predetermined orientation determined by the position of the shaft seam, and (c) fixing the shaft and club head relative to each other in said predetermined manner.

2. The method of assembling a golf club as in claim 1 comprising the step of orienting the shaft seam on the rear side of the golf club.

3. The method of assembling a golf club as in claim 1 comprising the step of orienting the shaft seam on the front side of the golf club.

4. The method of assembling a golf club as in claim 1 comprising the step of orienting the shaft seam at any 90 ° multiple with respect to the golf club front side.

5. The method of assembling a golf club as in claim 1 comprising the step of orienting the shaft seam with respect to the golf club front side in such a specific relationship to control the bending and flexing characteristics of the club to compensate for habitual deviations in the particular user's golf swing from the proper golf club path of movement when striking a golf ball.

6. The method of compensating for deviations in a golfer's swing wherein the golfer's club head path of movement when striking a golf ball habitually deviates from the proper path of movement wherein the golfer is using a golf club having a shaft having a circumference having a longitudinal seam inherently resulting from the shaft manufacture wherein the seam imparts to the shaft bending and flexing characteristics affecting the path of golf ball movement after being struck by the golf club and a club head affixed to the shaft having a ball-striking face comprising the steps of:

(a) locating the position of the shaft seam adjacent the club head, (b) orienting the shaft and seam to the club head in that orientation which will impart to the assembled shaft and club head those bending and flexing characteristics which best compensate for the habitual deviations of the user's golf swing from the correct golf swing, and (c) fixing the shaft and club head relative to each other in said orientation.

7. In a set of golf clubs consisting of a plurality of golf clubs wherein each club consists of an elongated shaft having a lower end and a club head affixed to the shaft lower end, the shaft having a circumference including an elongated longitudinal seam inherently resulting from the shaft manufacture and the assembled golf club having a front side defined by the direction of club movement during the striking of a golf ball and a rear side 180° opposite to the front side, characterized by the orientation of the shaft seam of each shaft of each golf club of the set being substantially identically oriented to its associated club head face.

8. In a set of golf clubs as in claim 7, the seams of each shaft being located on the rear side of the associated golf club.

9. In a set of golf clubs as in claim 7, the seams of each shaft being located on the front side of the associated golf club.

10. In a set of golf clubs as in claim 7, the seams of each shaft being oriented to the associated club head in that specific manner which imparts to the assembled golf club those bending and flexing characteristics which best compensate for habitual deviations of the user's golf swing from the correct golf swing.

* * * * *